US010021992B2

(12) United States Patent
Mesko et al.

(10) Patent No.: US 10,021,992 B2
(45) Date of Patent: Jul. 17, 2018

(54) POWER ADJUSTMENT AND SAFETY SYSTEMS FOR POWER MOTION FURNITURE

(71) Applicant: Raffel Systems, LLC, Germantown, WI (US)

(72) Inventors: Tyler Mesko, Germantown, WI (US); Richard M. Weeden, Germantown, WI (US); Douglas A. Dorn, Germantown, WI (US)

(73) Assignee: Raffel Systems, LLC, Germantown, WI (US)

( * ) Notice: Subject to any disclaimer, the term of this patent is extended or adjusted under 35 U.S.C. 154(b) by 142 days.

(21) Appl. No.: 15/278,404

(22) Filed: Sep. 28, 2016

(65) Prior Publication Data

US 2018/0084922 A1 Mar. 29, 2018

(51) Int. Cl.

| | |
|---|---|
| ***A47C 31/00*** | (2006.01) |
| ***A47C 7/56*** | (2006.01) |
| ***A47C 7/50*** | (2006.01) |

(52) U.S. Cl.

CPC ..... *A47C 31/00* (2013.01); *A47C 7/506* (2013.01); *A47C 7/563* (2013.01)

(58) Field of Classification Search

CPC ..... A47C 31/00; A47C 7/506; A47C 7/563

USPC ..... 297/217.3, 330

See application file for complete search history.

(56) References Cited

U.S. PATENT DOCUMENTS

| | | | | |
|---|---|---|---|---|
| 4,007,960 | A | 2/1977 | Gaffney | |
| 4,083,599 | A | 4/1978 | Gaffney | |
| 4,993,777 | A | 2/1991 | Lapointe | |
| 5,467,002 | A | 11/1995 | Brooks | |
| 5,931,532 | A | 8/1999 | Kemmerer et al. | |
| 7,823,972 | B2 | 11/2010 | Browne et al. | |
| 9,358,167 | B2 | 6/2016 | Lapointe et al. | |
| 9,730,518 | B1 * | 8/2017 | Jacobs | A47C 1/0242 |
| 2006/0103209 | A1 * | 5/2006 | Olcheski | A61G 5/14 297/330 |

* cited by examiner

*Primary Examiner* — Anthony D Barfield
(74) *Attorney, Agent, or Firm* — Casimir Jones S.C.; Tyler J. Sisk

(57) ABSTRACT

The present invention relates to safety mats for power motion furniture, power motion furniture systems comprising electronic architecture including the safety mats, and methods of using the same. In particular, the present invention provides object sensing safety mats for use with power motion furniture wherein the safety mats sense obstructions of movement between an extended or raised configuration of the power motion furniture and prevents movement or return of the extended or raised configuration when an obstruction is detected.

20 Claims, 8 Drawing Sheets

Check Buttons Function

Key Execute Function

A

B

POWER ADJUSTMENT AND SAFETY SYSTEMS FOR POWER MOTION FURNITURE

FIELD OF THE INVENTION

The present invention relates to power adjustment and safety systems for power motion furniture, power motion furniture systems comprising electronic architecture including the power adjustment and safety systems, and methods of using the same. In particular, the present invention provides power adjustment and safety systems comprising object sensing safety mats and safety mat controllers for use with power motion furniture wherein the safety mats and controllers sense obstructions of movement between an extended or raised configuration of the power motion furniture and prevents movement or return of the extended or raised configuration when an obstruction is detected.

BACKGROUND OF THE INVENTION

Many types of furniture exist in the marketplace. Some furniture contains features that allow for manual adjustment of the furniture (e.g., a LA-Z-BOY manual recliner, Monroe, Mich.). Other furniture contains powered (e.g., electronically, pneumatically, hydraulically, etc.) actuators that move furniture in an effortless manner (e.g., via the push of a button). Examples of power motion furniture include, but are not limited to, lift-chairs and power recline chairs. Powered lift chairs have been available in the marketplace for some time and are generally used by persons needing assistance in moving from a standing to a seated position and from a sitting to a standing position. Powered lift chairs generally contain a powered lift mechanism (e.g., electronically powered actuator) that raises a chair from a seating position to a raised position in which the seat is raised and tilted forward to assist the person to her/his feet, and likewise, when the lift mechanism is powered in reverse, lowers the person from a standing position into a seated position. Exemplary lift chairs are described in U.S. Pat. Nos. 4,007,960, 4,083,599, 5,931,532, and 4,993,777. Powered recline chairs, and furniture arrangements containing them (e.g., theater seating arrangements, sofas, medical examination chairs used during medical, dental and optical examinations etc.) have also been available in the marketplace for some time (e.g., see U.S. Pat. No. 5,467,002). Many times, these chairs have both a powered lift capability as well as a powered recline capability, are power operated by electric motors or hydraulic motors, and may be moved vertically with respect to a base and/or reclined to place an occupant in a supine position. For example, powered lift chairs are often also powered to move into a reclined position (e.g., when the chair is in a seating position, the back of the chair is powered to recline, and a leg rest portion of the chair is powered to raise, by the powered lift mechanism (e.g., powered actuator).

SUMMARY OF THE INVENTION

The present invention relates to power adjustment and safety systems for power motion furniture, power motion furniture systems comprising electronic architecture including the power adjustment and safety systems, and methods of using the same. In particular, the present invention provides power adjustment and safety systems comprising object sensing safety mats and safety mat controllers for use with power motion furniture wherein the safety mats and controllers sense obstructions of movement between an extended or raised configuration of the power motion furniture and prevents movement or return of the extended or raised configuration when an obstruction is detected.

Accordingly, in some embodiments, the present invention provides a powered adjustment system for a chair (e.g., a lift chair or a powered recline chair) comprising an actuator, an electronic actuator controller that controls operation of the actuator, an electronic floor sensor mat controller connected to (e.g., electronically (e.g., wired or wirelessly connected to) the electronic actuator controller and/or to the electronic actuator (e.g., in-line between the electronic actuator controller and the actuator), and a floor sensor mat. In some embodiments, the floor sensor mat is independent of the chair (e.g., other than electronic connection, it is otherwise not a part of nor connected to the chair). In some embodiments, the floor mat takes the shape of empty space beneath the lift chair. In further embodiments, the floor mat is exposed when the lift chair is in a raised, forward tilting position. In some embodiments, the floor mat is electronically connected (e.g., wired or wirelessly connected) to the electronic floor sensor mat controller. In some embodiments, the electronic actuator controller is communicatively coupled to the actuator and electronic floor sensor mat controller (e.g., operatively configured to selectively control operation of the actuator when the floor sensor mat controller identifies the presence of an object on the floor sensor mat). The invention is not limited by how the electronic floor sensor mat controller is communicatively coupled to the electronic actuator controller. In some embodiments, the communicative coupling is via wiring. In other embodiments, the communicative coupling is via wireless connection (e.g., BLUETOOTH, WIFI, or other wireless/radiofrequency communication). In some embodiments, communicative coupling of the electronic floor sensor mat controller to the actuator controller selectively controls operation of the actuator thereby preventing lowering of the lift chair from a raised forward tilting position into a seating position (e.g., when the electronic floor sensor mat controller identifies the presence of an object on the floor sensor mat). In some embodiments, the powered adjustment system further comprises a footrest sensor mat (e.g., located upon the bottom surface of a footrest component of a chair (e.g., a powered recline chair, a lift chair, etc.). In some embodiments, the electronic floor sensor mat controller houses and/or employs software that identifies if an object is present on the floor sensing mat and/or if an object is in contact with the footrest sensor mat. The invention is not limited by the type of software utilized to identify if an object is present and/or in contact. In some embodiments, the software employed by the floor sensor mat controller actively monitors the status of a material within the floor sensor mat and/or footrest sensor mat. In some embodiments, the software identifies a change in the status of the material as the presence of an object on the floor sensor mat and/or in contact with footrest sensor mat. The invention is not limited by the type of material within the floor sensor mat and/or footrest sensor mat. Indeed, any material in which or upon which a change can be detected may be utilized. In some embodiments, the material is an electric conductive material. Numerous electric conduction materials may be used including, but not limited to, a metal, an electrolyte, a plasma, a graphite, a conductive polymer, or a combination thereof. In some embodiments, the change in the status of the material detected is an electrical change. In other embodiments, the material within the floor sensor mat and/or footrest sensor mat is a diaphragm or bladder. The invention is not limited by the type of material from which the diaphragm or bladder is composed. Indeed, a variety of materials may be used including, but not limited to, metal, ceramic, silicon, polysilicon, rubber, plastic, thin film, bonded metal foil, thick film, and sputtered thin film. In some embodiments, the change in the status of the material detected is a change in strain, pressure, deflection, or a combination thereof.

In another embodiment, the invention provides a power motion furniture apparatus comprising a chair comprising: a seat portion; a backrest portion; a base upon which the seat portion and the backrest portion are connected; and a frame configured to pivotally support the base from a floor, such that the frame and the base interdependently define the height and tilt angle of the seat and backrest portions from the floor; and a powered adjustment system of the invention. In some embodiments, the powered adjustment system is configured to move the chair base from a seating position whereby the chair base rests upon the chair frame into a raised forward tilting position whereby the chair seat and chair backrest are in a raised and forward tilting position and a space exists between the chair base and the chair frame. In further embodiments, the powered adjustment system comprises an actuator, an electronic actuator controller that controls operation of the actuator, an electronic floor sensor mat controller, wherein the electronic floor sensor mat controller (e.g., electronically connected in-line between the electronic actuator controller and the actuator), and a floor sensor mat. In some embodiments, the floor mat takes the shape of empty space beneath the lift chair. In further embodiments, the floor mat is exposed when the lift chair is in a raised, forward tilting position. In some embodiments, the floor mat is electronically connected (e.g., wired or wirelessly connected) to the electronic floor sensor mat controller. In some embodiments, the electronic actuator controller is communicatively coupled to the actuator and electronic floor sensor mat controller (e.g., operatively configured to selectively control operation of the actuator when the floor sensor mat controller identifies the presence of an object on the floor sensor mat). The invention is not limited by how the electronic floor sensor mat controller is communicatively coupled to the electronic actuator controller. In some embodiments, the communicative coupling is via wiring. In other embodiments, the communicative coupling is via wireless connection (e.g., BLUETOOTH, WIFI, or other wireless/radiofrequency communication). In some embodiments, communicative coupling of the electronic floor sensor mat controller to the actuator controller selectively controls operation of the actuator thereby preventing lowering of the lift chair from a raised forward tilting position into a seating position (e.g., when the electronic floor sensor mat controller identifies the presence of an object on the floor sensor mat). In some embodiments, the powered adjustment system, subsequent to preventing lowering of the chair base from a raised forward tilting position into a seating position, raises the chair base from the raised forward tilting position into a higher raised forward tilting position. In some embodiments, the powered adjustment system further comprises a footrest sensor mat (e.g., located upon the bottom surface of a footrest component of the lift chair). In some embodiments, the electronic floor sensor mat controller houses and/or employs software that identifies if an object is present on the floor sensing mat and/or if an object is in contact with the footrest sensor mat. The invention is not limited by the type of software utilized to identify if an object is present and/or in contact. In some embodiments, the software employed by the floor sensor mat controller actively monitors the status of a material within the floor sensor mat and/or footrest sensor mat. In some embodiments, the software identifies a change in the status of the material as the presence of an object on the floor sensor mat and/or in contact with footrest sensor mat. The invention is not limited by the type of material within the floor sensor mat and/or footrest sensor mat. Indeed, any material in which or upon which a change can be detected may be utilized. In some embodiments, the material is an electric conductive material. Numerous electric conduction materials may be used including, but not limited to, a metal, an electrolyte, a plasma, a graphite, a conductive polymer, or a combination thereof. In some embodiments, the change in the status of the material detected is an electrical change. In other embodiments, the material within the floor sensor mat and/or footrest sensor mat is a diaphragm or bladder. The invention is not limited by the type of material from which the diaphragm or bladder is composed. Indeed, a variety of materials may be used including, but not limited to, metal, ceramic, silicon, polysilicon, rubber, plastic, thin film, bonded metal foil, thick film, and sputtered thin film. In some embodiments, the change in the status of the material detected is a change in strain, pressure, deflection, or a combination thereof. In some embodiments, the powered adjustment system, when selectively controlling operation, overrides input signals from a user control or switch of the power motion furniture. The invention is not limited by the type of switch or control that is overridden. In some embodiments, the control or switch is a handheld control. In some embodiments, the actuator controller (e.g., in communication with the floor sensor mat controller) prevents the base from being lowered until the floor sensor mat controller no longer identifies the presence of the object on the floor sensor mat. The invention is not limited by the type of power motion furniture apparatus (e.g., that comprises a chair). Indeed, any type of power motion furniture apparatus finds use in the invention including, but not limited to, a chair, a loveseat, a sofa, a sectional, and a theater seat. In some embodiments, components of the power motion furniture apparatus of the invention are retrofitted into an existing power motion furniture apparatus. For example, in some embodiments, an existing power motion furniture apparatus (e.g., a lift chair (e.g., comprising a chair comprising: a seat portion, a backrest portion, a base upon which the seat portion and the backrest portion are connected, and a frame configured to pivotally support the base from a floor, such that the frame and the base interdependently define the height and tilt angle of the seat and backrest portions from the floor, an actuator, and an electronic actuator controller that controls operation of the actuator)) is retrofitted (e.g., modified at a date later than its initial sale and or use in the marketplace) to include a powered adjustment system (e.g., containing an electronic floor sensor mat controller and a floor sensor mat) of the invention (e.g., electronic floor sensor mat controller is retrofittedly connected to (e.g., electronically (e.g., wired or wirelessly connected to)) the electronic actuator controller and/or to the electronic actuator (e.g., in-line between the electronic actuator controller and the actuator). The invention is not limited by the type of actuator of the power motion furniture apparatus. Indeed, the actuator may be any type of actuator including, but not limited to, an electronic actuator, a hydraulic actuator, and/or a pneumatic actuator. In some embodiments, the power motion furniture apparatus comprising a chair further comprises a powered leg rest component extendably connected to the chair base. In some embodiments, the powered leg rest component comprises a leg rest section and a footrest section, both leg rest and footrest sections having a top surface upon which the legs and feet of an occupant of the chair can rest and a bottom surface (e.g., when the leg rest component is in a stowed position the bottom surface of the leg rest and footrest sections are nearly perpendicular to, and below, the chair seat portion). In a further embodiment, the powered leg rest component comprises a footrest sensor mat located upon the bottom surface of the footrest section of the leg rest component. In some embodiments, the actuator (e.g., electronic, hydraulic and/or pneumatic actuator) powers the leg rest component to extend or retract between the stowed position and a fully extended position. In some embodiments, the footrest sensor mat is electronically connected to the electronic floor sensor mat controller. In a further embodiment, the electronic actuator controller (e.g., in communication with the floor mat controller) selectively controls actuation of the leg rest component (e.g., prevents retraction of the leg rest component from an extended position into a stowed position) when the floor sensor mat controller identifies the presence of an object in contact with the footrest sensor mat. In some embodiments, the electronic actuator controller (e.g., in communication with the floor mat controller) raises the leg rest component from an extended position into a further extended position subsequent to preventing retraction of the leg rest component from an extended position into a stowed position. In some embodiments, the electronic floor sensor mat controller houses and/or employs software that identifies if an object is present on the floor sensing mat and/or if an object is in contact with the footrest sensor mat. The invention is not limited by the type of software utilized to identify if an object is present and/or in contact. In some embodiments, the software employed by the floor sensor mat controller actively monitors the status of a material within the floor sensor mat and/or footrest sensor mat. In some embodiments, the software identifies a change in the status of the material as the presence of an object on the floor sensor mat and/or in contact with footrest sensor mat. The invention is not limited by the type of material within the floor sensor mat and/or footrest sensor mat. Indeed, any material in which or upon which a change can be detected may be utilized. In some embodiments, the material is an electric conductive material. Numerous electric conduction materials may be used including, but not limited to, a metal, an electrolyte, a plasma, a graphite, a conductive polymer, or a combination thereof. In some embodiments, the change in the status of the material detected is an electrical change. In other embodiments, the material within the floor sensor mat and/or footrest sensor mat is a diaphragm or bladder. The invention is not limited by the type of material from which the diaphragm or bladder is composed. Indeed, a variety of materials may be used including, but not limited to, metal, ceramic, silicon, polysilicon, rubber, plastic, thin film, bonded metal foil, thick film, and sputtered thin film. In some embodiments, the change in the status of the material detected is a change in strain, pressure, deflection, or a combination thereof. In some embodiments, the electronic actuator controller (e.g., in communication with the floor mat controller) selectively controls actuation of the leg rest component (e.g., prevents the leg rest component from retracting) until the floor sensor mat controller no longer identifies the presence of an object in contact with the footrest sensor mat. In other embodiments, the electronic actuator controller (e.g., in communication with the floor mat controller) selectively controls actuation of the leg rest component by overriding input signals from a user control or switch of the power motion furniture.

DETAILED DESCRIPTION OF THE INVENTION

The present invention relates to safety mats for power motion furniture, power motion furniture systems comprising electronic architecture including the safety mats, and methods of using the same. The present invention provides object sensing safety mat systems and components for use with power motion furniture. For example, the invention provides safety mats that sense obstructions of movement between an extended or raised configuration of the power motion furniture and prevents movement or return of the extended or raised configuration when an obstruction is detected.

The following embodiments are provided by way of example and are not intended to limit the invention to these particular configurations. Numerous other applications and configurations will be appreciated by those of ordinary skill in the art.

Conventional lift chairs usually include a base in the form of a steel frame which rests on a floor, a chair and an powered (e.g., electronically, hydraulically, pneumatically) operated lift mechanism which mounts the chair on the base and operates to power the chair between a reclining position, a seated position and a raised inclined position. A lift chair in a raised position poses a unique problem in that there is almost always a significant space that is open between the frame and the bottom of the chair, exposing not only the powered components of the chair, but also exposing people and pets to a potentially dangerous situation in which the person (e.g., infant child) or pet has all or a portion of their body within this space when chair is lowered from the raised position into a seating position. For example, as the chair is powered to lower into a seating position, a person or pet may become pinched, trapped and/or crushed between the frame and the downward moving chair leading to injury and/or death.

Figure 1:
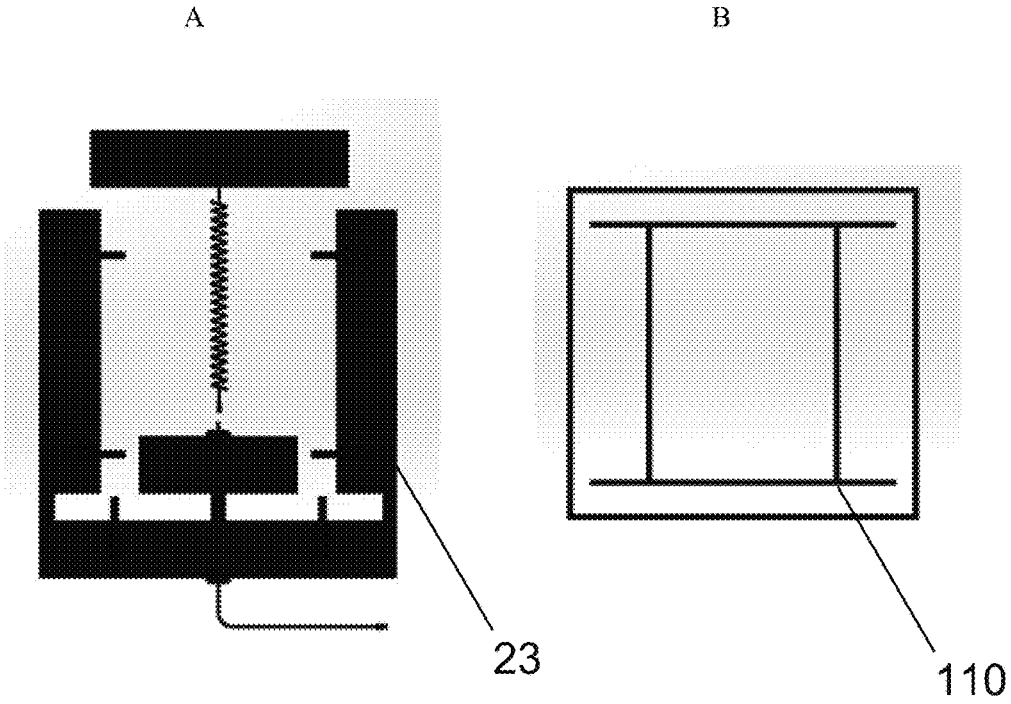
FIG. 1 depicts the difference in area coverage utilizing (A) a floor sensor mat of the invention in one non-limiting embodiment compared with (B) conventional ribbon strips available in the art. Non-blackened areas represent "blind spots" in which an object (e.g., a victim) cannot be detected.
Figure 2:
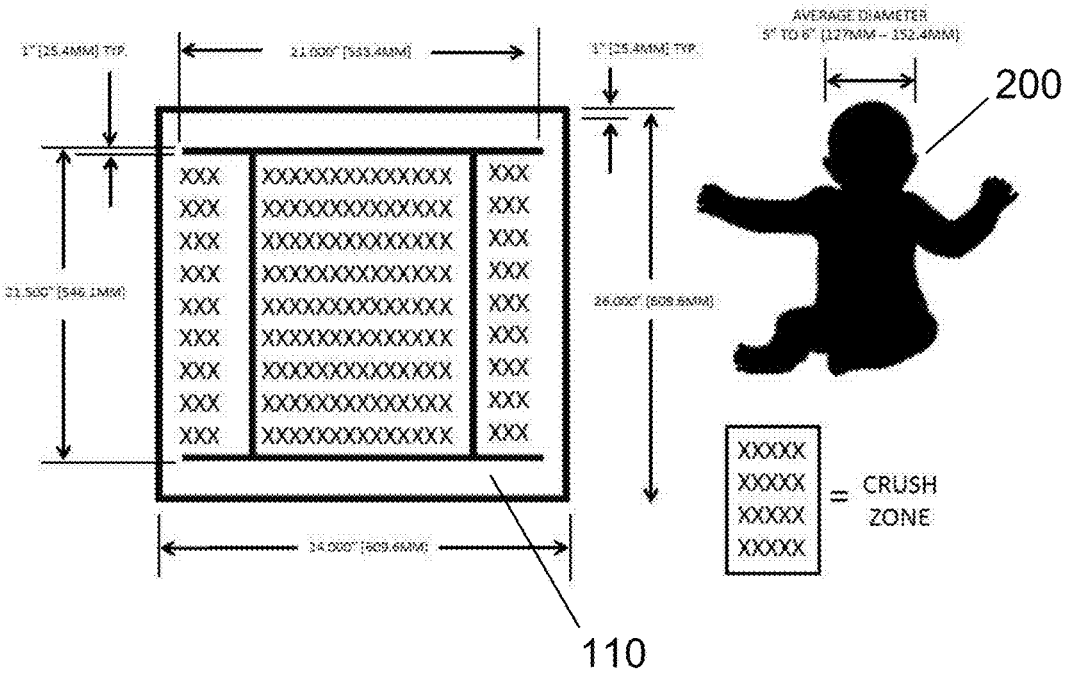
FIG. 2 depicts a scenario in which a victim can be crushed underneath a chair or other piece of furniture without making contact with conventional ribbon strips available in the art. A "crush zone" is demarcated by a series of X's and the dimensions compared with that of an human infant's head to illustrate risk.
Figure 3:
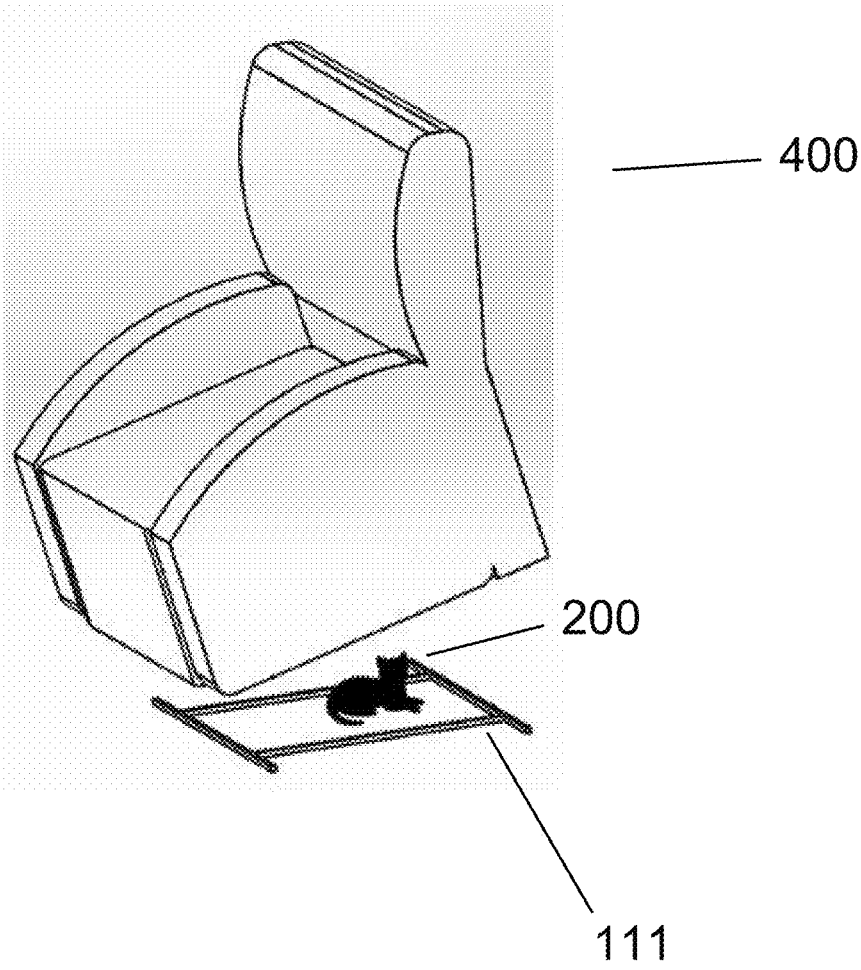
FIG. 3 is an illustration of how a victim may come to be crushed underneath a chair or other piece of furniture without making contact with conventional ribbon strips available in the art.
Figure 8:
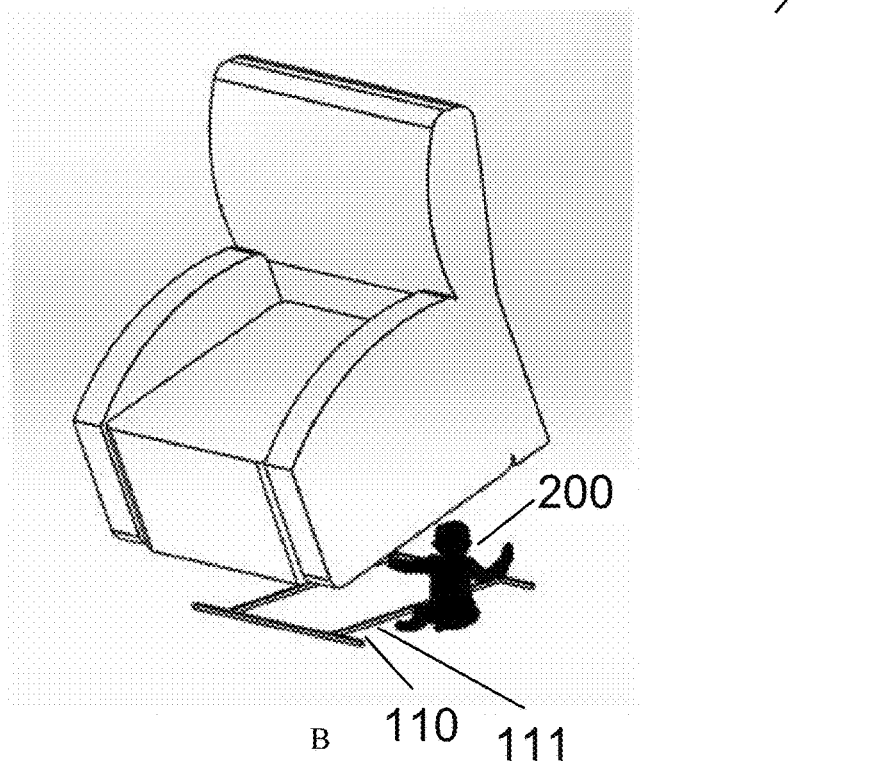
FIG. 8 shows two areas or zones of a power motion furniture apparatus in which a victim may be trapped and/or injured that in embodiments of the invention are, independently or collectively, actively monitored using devices, systems and methods of the invention. (A) A victim is trapped under the chair base when the chair is lowered from a raised forward tilting position into a seating position. (B) A victim is trapped between a chair base and a footrest component attached to the chair base when the footrest is lowered into a collapsed or closed position.
Figure 8:
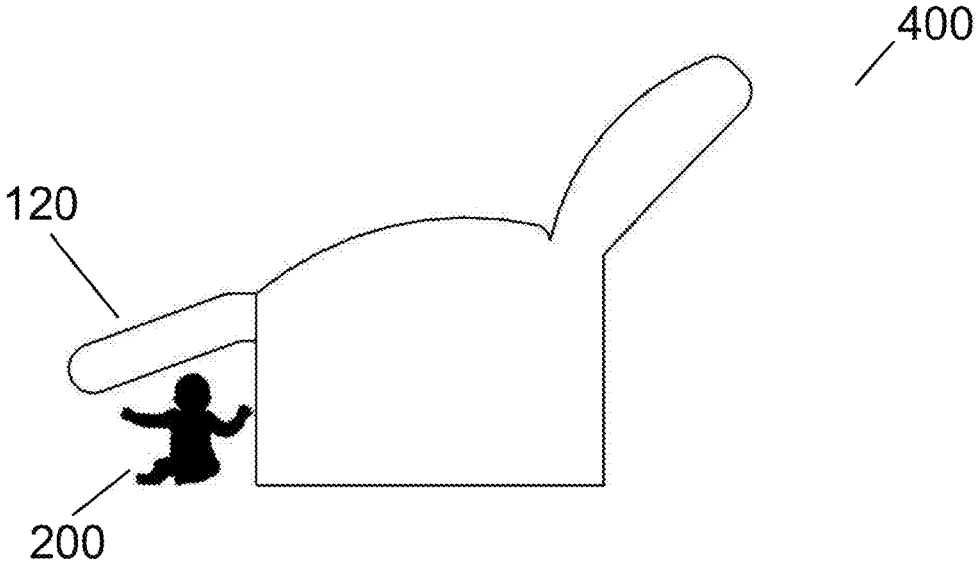

Pressure sensing ribbon strips have been utilized in the art as an attempt to prevent injury. Conventional ribbon strips suffer from only being able to detect and account for the area directly under the perimeter of the lift chair or on the chair frame. As shown in FIGS. 1B, 2-3 and 8A-8B, utilization of ribbon strips of the art fail to account for large areas not under the perimeter of the lift chair, where both small children and pets may often reside. In particular, FIGS. 2-3 and 8A-8B illustrate scenarios in which a victim 200 could be underneath a chair 400 using ribbon strip detection of the art without making contact with a ribbon strip 110 during a "crush" situation. Thus, it is possible for a victim 200 (e.g., small child or pet) to be underneath the chair 400 without ever coming into contact with the ribbon strip safety device 110 on the base perimeter or frame 111 of the chair 400 resulting in the potential risk of injury remaining high. In an exemplary embodiment, and as shown in FIG. 1B and FIG. 8A, the use of ribbon strips 110 on the frame portion 111 of a lift chair 400 actively monitors only about 120 $in^2$ (See FIG. 1B. dark black blackened area). However, as described in detail below (e.g., in FIG. 4), and as shown in FIG. 1A, a powered adjustment system for a lift chair comprising an electronic floor sensor mat controller 22 and a floor sensor mat 23 of the invention actively detects almost the entire space below the lift chair (e.g., in the exemplary embodiment of FIG. 1, about 1140 $in^2$ in total area). Furthermore, the powered adjustment system may optionally include a safety sensor mat 24 on the bottom facing side of the footrest (See FIG. 8B, 120) thereby permitting object sensing under virtually the entirety of the lift chair, drastically decreasing the risk of injury. Thus, in some embodiments, the invention provides a powered adjustment system that utilizes a pressure sensing floor mat with a secondary mat on the bottom facing side of the footrest that detects and/or senses objects under virtually the entirety of the lift chair, drastically decreasing the risk of injury.

Figure 4:
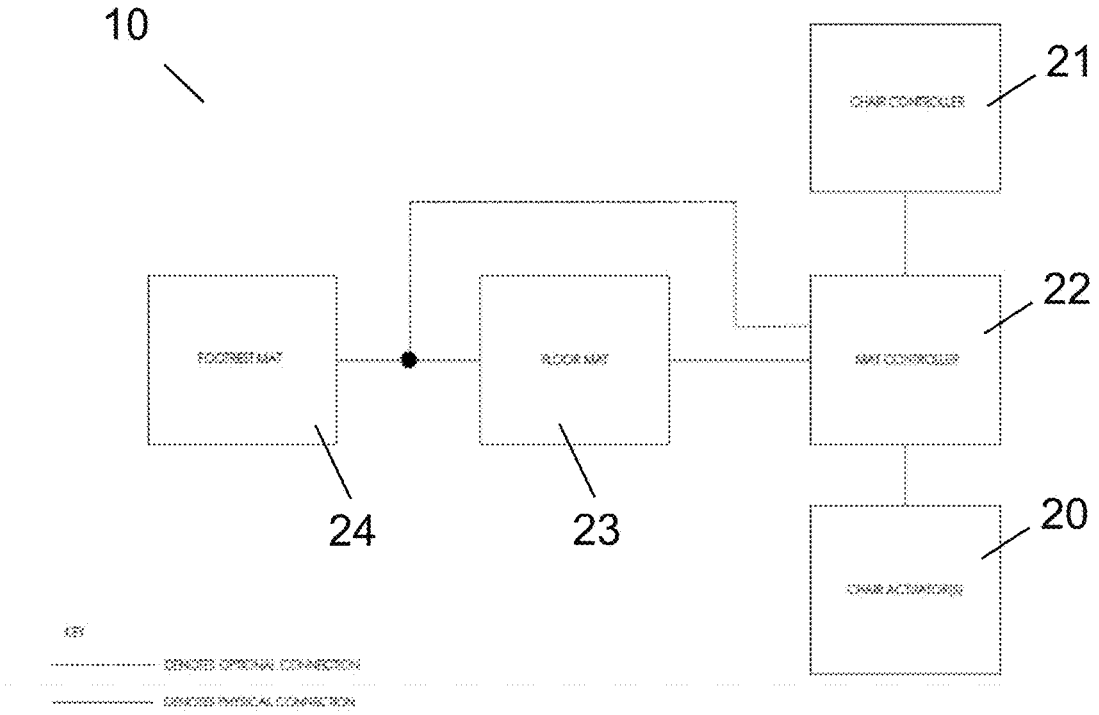
FIG. 4 shows a diagram indicating connectivity of components of a power motion furniture apparatus with a power adjustment system in one embodiment of the invention.

Non-limiting examples of a powered adjustment system (e.g., for a lift chair) of the invention is depicted in FIGS. 1A and 4-7 and described below. In some embodiments, and as shown in FIG. 4, a powered adjustment system 10 (e.g., for a lift chair) of the invention comprises an actuator 20; an electronic actuator controller 21 that controls operation of the actuator 20; an electronic floor sensor mat controller 22 connected to (e.g., electronically (e.g., wired or wirelessly connected to)) the electronic actuator controller 21 and/or to the electronic actuator 20 (e.g., in-line between the electronic actuator controller 21 and the actuator 20); and a floor sensor mat 23. In some embodiments, the floor sensor mat 23 is independent of a chair (e.g., lift chair) it controls (e.g., other than electronic connection, it is otherwise not a part of nor connected to a chair). In some embodiments, the floor mat 23 takes the shape of empty space beneath a lift chair. In further embodiments, the floor mat 23 is exposed when the lift chair is in a raised, forward tilting position. In some embodiments, the floor mat 23 is electronically connected (e.g., wired or wirelessly connected) to the electronic floor sensor mat controller 22 (e.g., as depicted as a solid line in FIG. 4). In some embodiments, the electronic actuator controller 21 is communicatively coupled to the actuator 20 and electronic floor sensor mat controller 22. As described herein, the invention is not limited by how the electronic floor sensor mat controller 22 is communicatively coupled to the electronic actuator controller 21. In some embodiments, the communicative coupling is via hard wiring. In other embodiments, the communicative coupling is via wireless connection (e.g., BLUETOOTH, WIFI, or other wireless/radiofrequency communication). In some embodiments, communicative coupling of the electronic floor sensor mat controller 22 to the actuator controller 21 selectively controls operation of the actuator 20 thereby preventing lowering of the lift chair from a raised forward tilting position into a seating position (e.g., when the electronic floor sensor mat controller 22 identifies the presence of an object on the floor sensor mat 23). In some embodiments, the powered adjustment system 10 further comprises a footrest sensor mat 24 (e.g., located upon the bottom surface of a footrest component of the lift chair). In some embodiments, the electronic floor sensor mat controller 22 houses and/or employs software that identifies if an object is present on the floor sensing mat and/or if an object is in contact with the footrest sensor mat. The invention is not limited by the type of software utilized to identify if an object is present and/or in contact.

Figure 5:
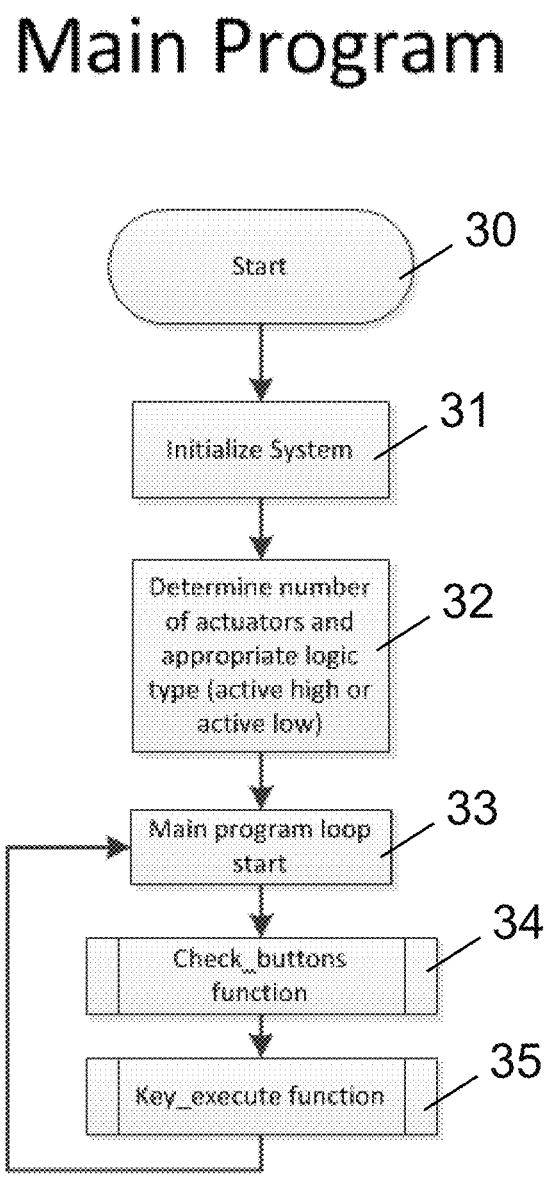
FIG. 5 depicts a non-limiting example of logic flow of an algorithm run by a controller of a power motion furniture apparatus of the invention.
Figure 6:
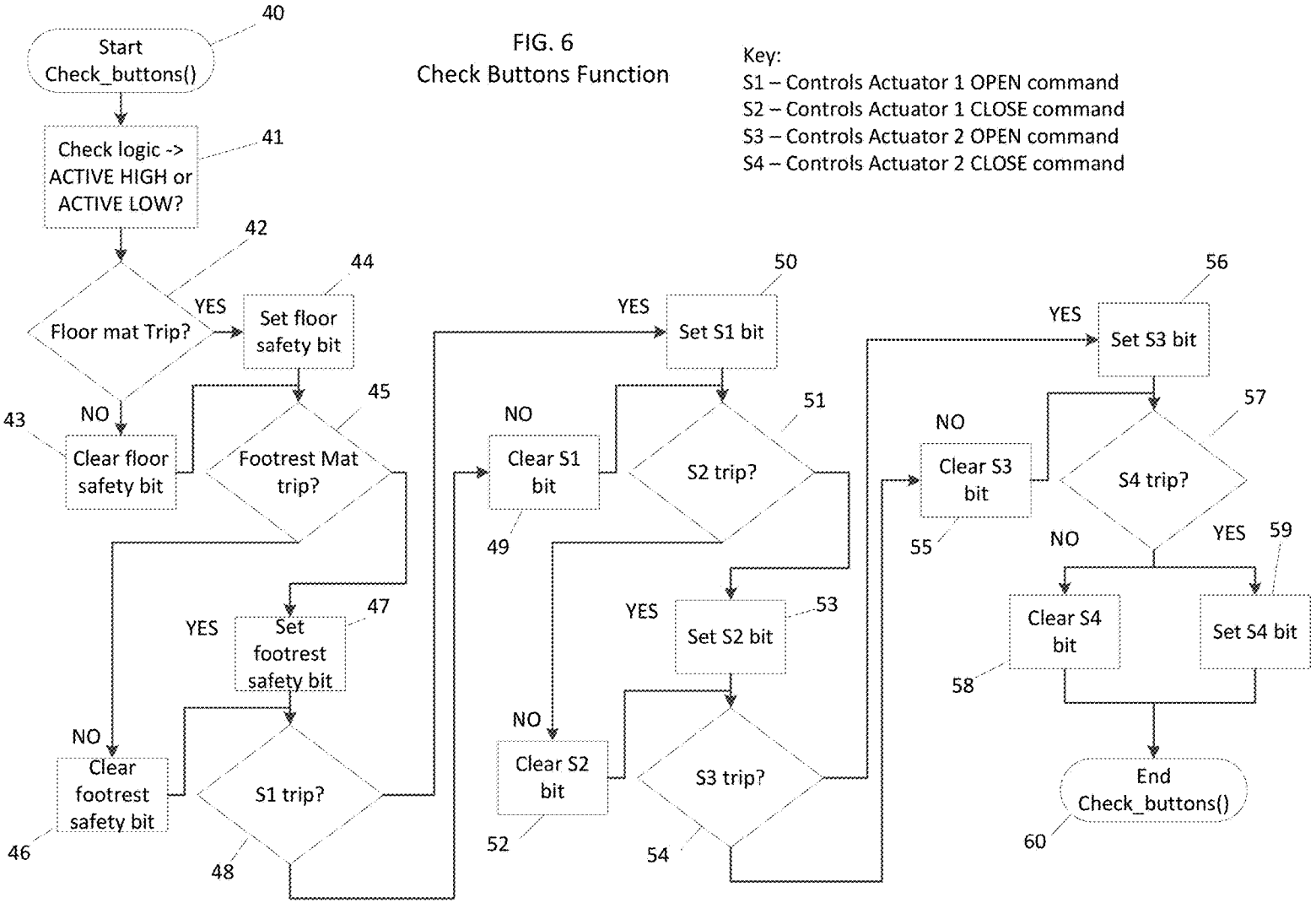
FIG. 6 depicts a non-limiting example of logic flow of an algorithm run by a controller of a power motion furniture apparatus of the invention.
Figure 7:
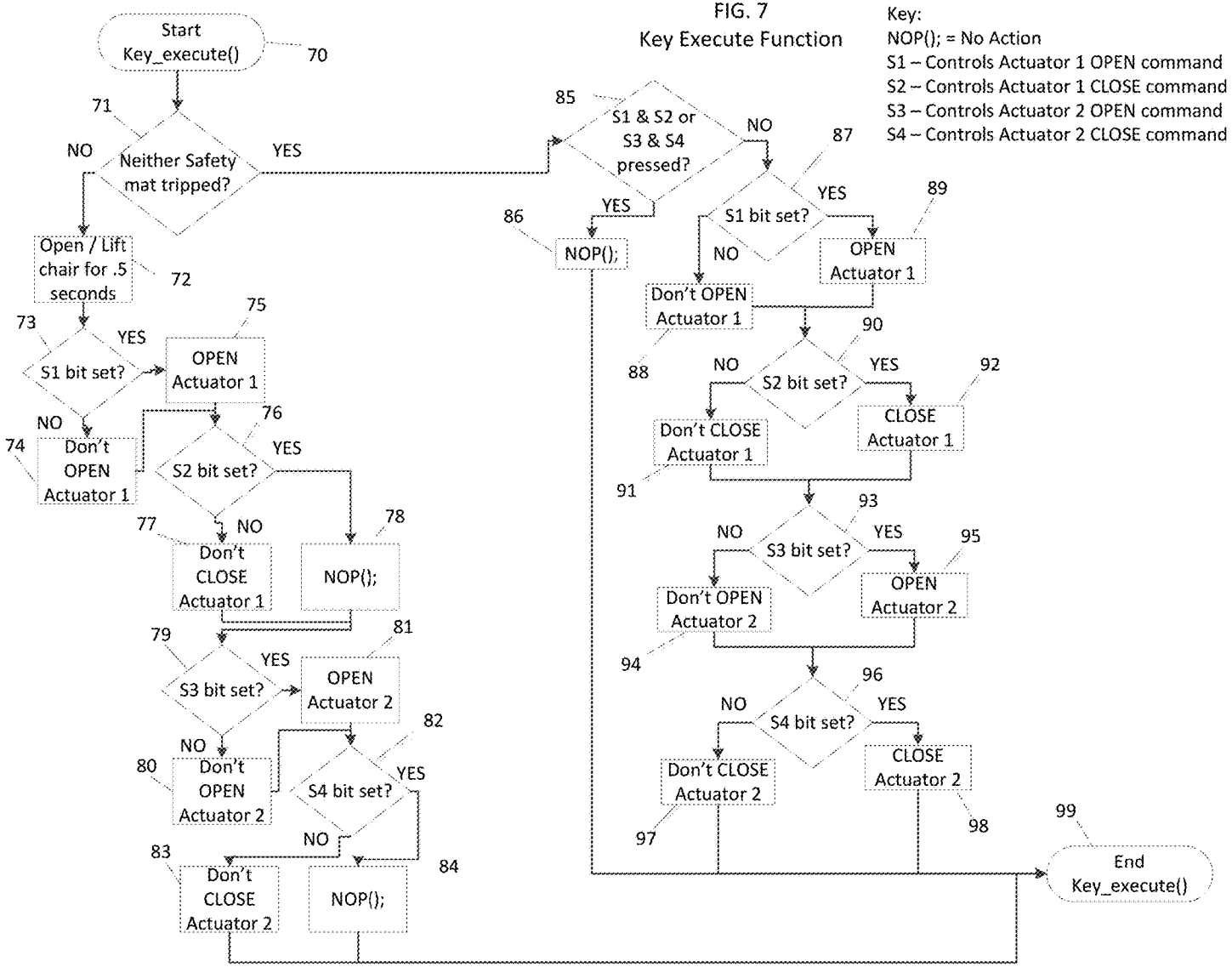
FIG. 7 depicts a non-limiting example of logic flow of an algorithm run by a controller of a power motion furniture apparatus of the invention.

FIG. 5 shows an example process (e.g., logic and/or an algorithm (e.g., encoded in and/or executed by software housed and/or employed by an electronic floor sensor mat controller 22)) for a safety system for power motion furniture. In some embodiments, the process includes active decision steps that permit the floor sensor mat controller to detect interaction between a chair controller and a chair actuator(s), allows a pass through of a signal from the chair controller to the chair actuator(s) when no object is detected (e.g., on the floor mat and/or footrest mat), and interrupts/replaces the signal from a chair controller to a chair actuator (s) when an object is detected (e.g., on the floor mat and/or footrest mat). For example, the process may include, but is not limited to, steps comprising start 30, initialization 31, motor detection and control 32 (e.g., open and close control), check status 34 (e.g., check button status), execution 35, as well as looping 33 (e.g., loop to start) steps. FIG. 6 shows example decision steps 40-60 (e.g., active decision steps of an algorithm encoded in and/or executed by software housed and/or employed by an electronic floor sensor mat controller) of a check status step of a safety system for power motion furniture. FIG. 7 shows example decision steps 70-99 (e.g., active decision steps of an algorithm encoded in and/or executed by software housed and/or employed by an electronic floor sensor mat controller) of an execution step of a safety system for power motion furniture.

In one embodiment, software run by a sensor mat controller 22 actively monitors the status of a material within the floor sensor mat 23 and/or footrest sensor mat 24 according to one or more processes depicted in FIGS. 5, 6, and/or 7. For example, in some embodiments, upon detection of an object on or in contact with a floor sensor mat 23 and/or footrest sensor mat 24 of a safety system for power motion furniture (e.g., upon compression of either floor mat and/or footrest mat, a connection made by contact of two conductive sheets on each side of a non-conducting hatched separator completes an electrical circuit that provides a signal to the floor sensor mat controller that an object (e.g., potential crush victim) is in contact with a floor mat and/or a footrest mat), the floor sensor mat controller, upon receipt of a signal that an object is on or in contact with a sensor mat, impedes the chair controller from activating/moving the chair actuator(s) (e.g., in a direction that endangers the object(s) in contact with either mat)).

A power adjustment safety system of the invention is not limited by the type of floor sensor mat controller utilized. Indeed, any controller that can read, sense and/or detect the state of a signal (e.g., the state of an electronic circuit (e.g., a logic level state (e.g., ON, OFF; Binary 1, Binary 0; and/or Arduino HIGH, LOW))) may be used as a floor sensor mat controller. For example, in some embodiments, a microcontroller/microprocessor used in a sensor system of the invention reads a logic level input (e.g., a logic level input from a floor sensor mat and/or a footrest sensor mat (e.g., a Binary 1/Logic HIGH or a Binary 0/Logic LOW)). In some embodiments, a microcontroller/microprocessor used in a sensor system of the invention reads an analog signal input (e.g., an analog signal from a floor sensor mat and/or a footrest sensor mat (e.g., a variable range signal from 0V to Vcc (e.g., Vcc being, in some embodiments, 3.3 VDC or 5 VDC)). In some embodiments, a microcontroller/microprocessor used in a sensor system of the invention reads output signal from a pressure sensor (e.g., a pressure sensor signal providing information regarding pressure within a floor sensor mat and/or a footrest sensor mat compared to surrounding atmospheric pressure (e.g., translated to equivalent analog voltages (e.g., in some embodiments, voltages ranging from 0V to Vcc (e.g., 3.3 VDC or 5 VDC). Numerous microcontrollers/microprocessors that can read, sense and/or detect the state of a signal are well known in the art and any such microcontroller/microprocessor may be used in a power adjustment safety system of the invention. Furthermore, any controller that can be operatively connected to other components (e.g., an actuator controller, an actuator, a floor sensor mat, and/or a footrest sensor mat) and that can house and employ (e.g., run) software configured to actively monitor the status of one or more sensor mats (e.g., floor sensor mat and/or footrest sensor mat) finds use in the invention. Exemplary controllers for use in a sensor system of the invention include, but are not limited to, a peripheral interface controller (PIC) (e.g., a PIC microcontroller manufactured by MICROCHIP, Chandler, Ariz. (e.g., PIC16F1933 microcontroller)) and/or a Reduced Instruction Set Computing (RISC) designed microcontroller (e.g., a RISC based microcontroller manufactured by ATMEL, San Jose, Calif. (e.g., ATMEGA328p microcontroller)).

In some embodiments, software employed by a floor sensor mat controller 22 actively monitors the status of a material within the floor sensor mat 23 and/or footrest sensor mat 24 (e.g., in accordance with logic depicted in FIGS. 5, 6, and/or 7). In some embodiments, the software identifies a change in the status of the material as the presence of an object on the floor sensor mat 23 and/or in contact with footrest sensor mat 24. The invention is not limited by the type of material within the floor sensor mat and/or footrest sensor mat. Indeed, any material in which or upon which a change can be detected may be utilized. In some embodiments, the material is an electric conductive material. Numerous electric conduction materials may be used including, but not limited to, a metal, an electrolyte, a plasma, a graphite, a conductive polymer, or a combination thereof. In some embodiments, the change in the status of the material detected is an electrical change. In other embodiments, the material within the floor sensor mat and/or footrest sensor mat is a diaphragm or bladder. The invention is not limited by the type of material from which the diaphragm or bladder is composed. Indeed, a variety of materials may be used including, but not limited to, metal, ceramic, silicon, polysilicon, rubber, plastic, thin film, bonded metal foil, thick film, and sputtered thin film. In some embodiments, the change in the status of the material detected is a change in strain, pressure, deflection, or a combination thereof.

The present invention provides significant advantages and improvement to existing powered motion furniture. For example, components of the power motion furniture apparatus of the invention are useful in retrofit applications (e.g., thereby transforming the safety and utility of existing power motion furniture apparatus). For example, in some embodiments, an existing power motion furniture apparatus (e.g., a lift chair (e.g., comprising a chair comprising: a seat portion; a backrest portion; a base upon which the seat portion and the backrest portion are connected; and a frame configured to pivotally support the base from a floor, such that the frame and the base interdependently define the height and tilt angle of the seat and backrest portions from the floor; an actuator; and an electronic actuator controller that controls operation of the actuator)) is retrofitted to include a power adjustment system 10 (e.g., comprising an electronic floor sensor mat controller 22 and a floor sensor mat 23 and optionally a footrest sensor mat 24) of the invention. Thus, in some embodiments, and unlike any other safety features available in the art, a powered adjustment system 10 of the present invention is operatively configured to work universally with all chair controller 21 and actuator 20 combinations (e.g., by fitting in-line (e.g., between) a chair controller 21-actuator 20 interface). Thus, in some embodiments, a powered adjustment system 10 of the present invention replaces the interface between a chair controller 21 and a chair actuator 20 with a new control interface in which a floor sensor mat controller 22 is placed in-line between the chair controller 21 and the chair actuator 20. Thus, in some embodiments, the invention provides a powered adjustment system 10 that is retrofittable into any legacy chair controller system. In this way, and in some embodiments, a powered adjustment system 10 of the present invention functions as a barrier between chair controller 21 and chair actuator 20, thereby increasing reliability and safety of the power motion furniture apparatus. Additionally, a powered adjustment system 10 of the invention allows for individual components of the system to be removed and/or replaced (e.g., remotely installed) (e.g., thereby eliminating the need to replace all components of the system). For example, in some embodiments, any one or more of an actuator 20, an electronic actuator controller 21, an electronic floor sensor mat controller 22, a floor sensor mat 23 and/or a footrest sensor mat 24 can be replaced without the need to replace any of the other components of the powered adjustment system 10.

The invention is not limited by the type of power motion furniture apparatus (e.g., that comprises a chair) that utilizes a powered adjustment system 10 of the invention. Indeed, any type of power motion furniture apparatus finds use in the invention including, but not limited to, a chair, a loveseat, a sofa, a sectional, and a theater seat. Similarly, the invention is not limited by the type of actuator of the power motion furniture apparatus. Indeed, the actuator may be any type of actuator including, but not limited to, an electronic actuator, a hydraulic actuator, and/or a pneumatic actuator. In some embodiments, the power motion furniture apparatus comprising a chair further comprises a powered leg rest component extendably connected to the chair base. In some embodiments, the powered leg rest component comprises a leg rest section and a footrest section, both leg rest and footrest sections having a top surface upon which the legs and feet of an occupant of the chair can rest and a bottom surface (e.g., when the leg rest component is in a stowed position the bottom surface of the leg rest and footrest sections are nearly perpendicular to, and below, the chair seat portion). Numerous powered recline chairs are known in the art including those for residential as well as commercial (e.g., doctor's office, dentist's office, hospitals, etc.) use. In a further embodiment, the powered leg rest component comprises a footrest sensor mat located upon the bottom surface of the footrest section of the leg rest component. In some embodiments, the actuator (e.g., electronic, hydraulic and/or pneumatic actuator) powers the leg rest component to extend or retract between a stowed position and a fully extended position. In some embodiments, the footrest sensor mat is electronically connected to the electronic floor sensor mat controller. In a further embodiment, the electronic actuator controller (e.g., in communication with the floor mat controller) selectively controls actuation of the leg rest component (e.g., prevents retraction of the leg rest component from an extended position into a stowed position) when the floor sensor mat controller identifies the presence of an object in contact with the footrest sensor mat. In some embodiments, the electronic actuator controller (e.g., in communication with the floor mat controller) raises the leg rest component from an extended position into a further extended position subsequent to preventing retraction of the leg rest component from an extended position into a stowed position. In some embodiments, the electronic floor sensor mat controller houses and/or employs software that identifies if an object is present on the floor sensing mat and/or if an object is in contact with the footrest sensor mat. The invention is not limited by the type of software utilized to identify if an object is present and/or in contact. In some embodiments, the software employed by the floor sensor mat controller actively monitors the status of a material within the floor sensor mat and/or footrest sensor mat. In some embodiments, the software identifies a change in the status of the material as the presence of an object on the floor sensor mat and/or in contact with footrest sensor mat. The invention is not limited by the type of material within the floor sensor mat and/or footrest sensor mat. Indeed, any material in which or upon which a change can be detected may be utilized. In some embodiments, the material is an electric conductive material. Numerous electric conduction materials may be used including, but not limited to, a metal, an electrolyte, a plasma, a graphite, a conductive polymer, or a combination thereof. In some embodiments, the change in the status of the material detected is an electrical change. In other embodiments, the material within the floor sensor mat and/or footrest sensor mat is a diaphragm or bladder. The invention is not limited by the type of material from which the diaphragm or bladder is composed. Indeed, a variety of materials may be used including, but not limited to, metal, ceramic, silicon, polysilicon, rubber, plastic, thin film, bonded metal foil, thick film, and sputtered thin film. In some embodiments, the change in the status of the material detected is a change in strain, pressure, deflection, or a combination thereof. In some embodiments, the electronic actuator controller (e.g., in communication with the floor mat controller) selectively controls actuation of the leg rest component (e.g., prevents the leg rest component from retracting) until the floor sensor mat controller no longer identifies the presence of an object in contact with the footrest sensor mat. In other embodiments, the electronic actuator controller (e.g., in communication with the floor mat controller) selectively controls actuation of the leg rest component by overriding input signals from a user control or switch of the power motion furniture.

In some embodiments, the present invention provides power motion furniture retrofitted to incorporate and utilize a powered adjustment system 10 of the present invention. For example, as the components of the powered adjustment system 10 (e.g., an actuator 20, an electronic actuator controller 21, an electronic floor sensor mat controller 22, a floor sensor mat 23 and/or a footrest sensor mat 24) are each self-contained (e.g., they are separate components of the powered adjustment system 10), any existing actuator systems (e.g., any existing actuator controller, actuator, and/or actuator controller-actuator combination) are compatible with the invention. The invention therefore provides, in some embodiments, physical connections and/or connectors (e.g., wired connections/connectors) as well as non-physical (e.g., non-wired) connections (e.g., wireless (e.g., BLUETOOTH, WIFI, etc.) connections)) between an actuator controller and an actuator (e.g., electric, hydraulic, and/or pneumatic actuator) of a piece of power motion furniture that include components of the powered adjustment system 10 (e.g., an electronic floor sensor mat controller 22, a floor sensor mat 23 and/or a footrest sensor mat 24) of the invention. The invention is not limited by the type of connections and/or connectors. The type of physical connection and/or connector may be selected based upon the type of actuator/motor of the furniture (e.g., any type of physical connection and/or connector known in the art can be adapted to control an actuator/motor). Exemplary physical connection and/or connector include, but are not limited to, any physical connection and/or connector that provides ground, power, and/or direction of current. Similarly, the invention is not limited by the type of non-wired connections. Such non-wired connections are well known in the art and include, but are not limited to, BLUETOOTH, WIFI, and other radio frequency connections.

The invention is not limited to any particular type or means by which a user of a piece of powered motion furniture interacts with an actuator controller (e.g., in order to instruct the actuator of the powered motion furniture to lift and tilt up into a raised and forward tilting position or to lower and retract into a seating position under power). Many devices are known in the art that enable a user of a piece of powered motion furniture to control/power an actuator (e.g., to raise and/or lower a chair) including, but not limited to, switches, buttons, handheld controllers containing switches and buttons, etc.

The present invention is not limited to any particular controls or switches (e.g., that may be overridden using a power adjustment system of the invention). For example, controls that find use in the present invention include, but are not limited to, hand controls (push button, touch sensor), mounted controls (push button, touch sensor, LCD, motion sensing, voice activated), wireless controls (bluetooth, RF, IR, WIFI), tactile switches, toggle switches, rocker switches, slide switches, and/or rotary switches.

In some embodiments, both a footrest sensor mat and floor sensor mat are used to detect when an object is present under the chair (e.g., when a human subject or a pet is under a raised footrest and/or under a raised chair). The electronic floor sensor mat controller 22, which is depicted on a connection diagram shown in FIG. 4 can in some embodiments be electrically connected in-line between the chair controller and the chair actuators/motors, and determines whether or not an object (e.g., human subject or a pet or an inanimate object) is present on the floor sensor mat and/or the footrest sensor mat via software execution on the sensor mat controller. As described herein, the invention is not limited by the type of material within the sensor mats. In one preferred embodiment, a sensor mat (e.g., floor sensor mat and/or a footrest sensor mat) comprises two conducting planes (e.g., of an electric conducting material) with a thin, non-conducting hatched separator (e.g., any substrate with spring-back properties that permits natural separation of two conductive layers that is also compressible so as to allow contact between the conductive layers when depressed (e.g., a thin layer of aerated foam, thick fabric, and/or flexible plastic)) operably configured such that the conducting planes make contact when an object is present on the mat (e.g., due to weight or pressure of the object (e.g., human person or pet)). In another preferred embodiment, a sensor mat (e.g., floor sensor mat and/or a footrest sensor mat) comprises an bladder or diaphragm (e.g., air bladder or diaphragm) that provides pressure feedback to the sensor mat controller (e.g., via an air hose). If the sensor mat controller identifies the presence of an object (e.g., person, pet, or an inanimate object) on either one of the sensor mats, the mat controller prevents lowering the chair (e.g., user instructed or commanded lowering (e.g., via activation of a switch or button (e.g., on the chair or present on a handheld control))), thereby preventing actuation. In some embodiments, if the sensor mat controller identifies the presence of an object (e.g., person, pet, or an inanimate object) on either one of the sensor mats, the mat controller not only stops the lowering or closing, but also lifts the chair and/or further extends the leg rest slightly (e.g., as a safety precaution to avoid trapping an object (e.g., person, pet, or inanimate object) in a pinch point. In further embodiments, the mat controller can be operatively configured to prevent the chair from being lowered and/or the leg rest from being retracted into a stowed position until the sensor mat controller no longer identifies the presence of an object (e.g., person, pet, or an inanimate object) on or against either one of the sensor mats. In such a way, systems and methods of the present invention address and prevent scenarios in which a user of powered motion furniture (e.g., an elderly person using a lift chair or a lift chair component of a furniture piece) becomes unable to operate the lift chair at a time in which a person or pet is at great risk of injury.

For example, the invention addresses and prevents scenarios in which an elderly person activates a lift chair to lower from a raised forward tilting position into a seating position, or activates a leg rest to retract from an extended position into a stowed position, by pressing a button on a handheld control, only to hear the cry of a small child or pet that has become trapped under the powered lowering of the raised chair or under the powered retraction of the extended leg rest, and in response to the cry the person panics and drops the chair's handheld control. Under such a scenario, the elderly person may be too low to stand up and get out of the chair on their own to retrieve the handheld control, all the while the small child or pet would otherwise remain trapped under the lowered chair or leg rest. As described in detail herein, the systems and methods of the present invention address and prevent these "trapping" scenarios. For example, the powered adjustment system of the invention, containing an electronic actuator controller that is communicatively coupled to the actuator and the electronic floor sensor mat controller, selectively controls operation of the actuator when an object is detected by the floor sensor mat controller (e.g., prevents lowering of the chair base from a raised forward tilting position into a seating position and/or prevents retraction of the leg rest into a stowed position). In further embodiments, the powered adjustment system of the invention, subsequent to preventing lowering of the chair base from a raised forward tilting position into a seating position and/or preventing retraction of the leg rest into a stowed position, may be operably configured to raise the chair base from the raised forward tilting position into a higher raised forward tilting position and/or extend the leg rest into a further extended position (e.g., when a "trapping" scenario is detected).

In some embodiments, a powered adjustment system of the invention comprises a material present in a floor sensor mat that is actively monitored (e.g., by software executed on the sensor mat controller) that is different from the material present in a footrest sensor mat that is actively monitored (e.g., by software executed on the sensor mat controller).

The present invention is not limited by the type of object and/or obstruction detected. Indeed a variety of objects may be detected including, but not limited to, people (e.g., infants, toddlers, adults), pets or animals, portions of a person's or pets body (e.g., hands, feet, arms, legs, heads, necks, ankles, toes, fingers, wrists, paws, tails, etc.), as well as any type of inanimate object.

In some embodiments, the present invention provides power motion furniture retrofitted to incorporate and utilize a powered adjustment system 10 (e.g., containing an electronic floor sensor mat controller 22, a floor sensor mat 23 and/or a footrest sensor mat 24) of the present invention. For example, in some embodiments, because the electronic floor sensor mat controller contains the logic/software, and the floor sensor mats and/or footrest sensor mats may be obtained independent of a power motion furniture piece, and they do not rely on any input from the actuators, any existing actuator systems are compatible with the invention.

Having described the invention in detail, those skilled in the art will appreciate that various modifications, alterations, and changes of the invention may be made without departing from the spirit and scope of the present invention. Therefore, it is not intended that the scope of the invention be limited to the specific embodiments illustrated and described.

All publications and patents mentioned in the above specification are herein incorporated by reference. Various modifications and variations of the described method and system of the invention will be apparent to those skilled in the art without departing from the scope and spirit of the invention. Although the invention has been described in connection with specific preferred embodiments, it should be understood that the invention as claimed should not be unduly limited to such specific embodiments. Indeed, various modifications of the described modes for carrying out the invention that are obvious to those skilled in the relevant fields, are intended to be within the scope of the following claims.

What is claimed is:

1. A power motion furniture apparatus comprising:

a) a chair comprising:

a seat portion;

a backrest portion;

a base upon which the seat portion and the backrest portion are connected; and a frame configured to pivotally support the base from a floor, such that the frame and the base interdependently define the height and tilt angle of the seat and backrest portions from the floor; and b) a powered adjustment system configured to move the chair base from a seating position whereby the chair base rests upon the chair frame into a raised forward tilting position whereby the chair seat and chair backrest are in a raised and forward tilting position and a space exists between the chair base and the chair frame, wherein the powered adjustment system comprises:

an actuator;

an electronic actuator controller that controls operation of the actuator;

an electronic floor sensor mat controller, wherein the electronic floor sensor mat controller is electronically connected in-line between the electronic actuator controller and the actuator; and a floor sensor mat, wherein the floor sensor mat is independent of the chair frame and chair base, takes the shape of the empty space therebetween, is exposed when the chair base is in a forward tilting position, and is electronically connected to the electronic floor sensor mat controller;

wherein the electronic actuator controller is communicatively coupled to the actuator and electronic floor sensor mat controller and selectively controls operation of the actuator when the floor sensor mat controller identifies the presence of an object on the floor sensor mat, wherein selectively controls operation comprises preventing lowering of the chair base from a raised forward tilting position into a seating position.

2. The power motion furniture apparatus of claim 1, wherein selectively controls operation further comprises, subsequent to preventing lowering of the chair base from a raised forward tilting position into a seating position, raising of the chair base from the raised forward tilting position into a higher raised forward tilting position.

3. The power motion furniture apparatus of claim 1, wherein the electronic floor sensor mat controller employs software that identifies if an object is present on the floor sensing mat.

4. The power motion furniture apparatus of claim 3, wherein the software employed by the floor sensor mat controller actively monitors the status of a material within the floor sensor mat.

5. The power motion furniture apparatus of claim 4, wherein the software identifies a change in the status of the material as the presence of an object on the mat.

6. The power motion furniture apparatus of claim 5, wherein a change in the status of the material is an electrical change.

7. The power motion furniture apparatus of claim 5, wherein a change in the status of the material is a change in strain, pressure, deflection, or a combination thereof.

8. The power motion furniture apparatus of claim 1, wherein the actuator controller prevents the base from being lowered until the floor sensor mat controller no longer identifies the presence of the object on the floor sensor mat.

9. The power motion furniture apparatus of claim 1, wherein the chair further comprises:

(c) a powered leg rest component extendably connected to the chair base, wherein the leg rest component comprises:

a leg rest section and a footrest section, both leg rest and footrest sections having a top surface upon which the legs and feet of an occupant of the chair can rest and a bottom surface, whereby when the leg rest component is in a stowed position the bottom surface of the leg rest and footrest sections are nearly perpendicular to, and below, the chair seat portion; and a footrest sensor mat located upon the bottom surface of the footrest section of the leg rest component.

10. The power motion furniture apparatus of claim 9, wherein the actuator powers the leg rest component to extend or retract between the stowed position and a fully extended position.

11. The power motion furniture apparatus of claim 9, wherein the footrest sensor mat is electronically connected to the electronic floor sensor mat controller.

12. The power motion furniture apparatus of claim 9, wherein the electronic actuator controller selectively controls actuation of the leg rest component when the floor sensor mat controller identifies the presence of an object in contact with the footrest sensor mat, wherein selectively controls actuation of the leg rest component comprises preventing retraction of the leg rest component from an extended position into a stowed position.

13. The power motion furniture apparatus of claim 12, wherein selectively controls actuation of the leg rest component overrides input signals from a user control or switch of the power motion furniture.

14. The power motion furniture apparatus of claim 9, wherein the actuator controller prevents the leg rest component from retracting until the floor sensor mat controller no longer identifies the presence of the object in contact with the footrest sensor mat.

15. A powered adjustment system for a lift chair comprising:

an actuator;

an electronic actuator controller that controls operation of the actuator;

an electronic floor sensor mat controller, wherein the electronic floor sensor mat controller is electronically connected in-line between the electronic actuator controller and the actuator; and a floor sensor mat, wherein the floor sensor mat:

is independent of the chair;

takes the shape of empty space beneath the lift chair;

is exposed when the lift chair is in a raised, forward tilting position; and is electronically connected to the electronic floor sensor mat controller;

wherein the electronic actuator controller is communicatively coupled to the actuator and electronic floor sensor mat controller and selectively controls operation of the actuator when the floor sensor mat controller identifies the presence of an object on the floor sensor mat, wherein selectively controls operation comprises preventing lowering of the lift chair from a raised forward tilting position into a seating position.

16. The powered adjustment system for a lift chair of claim 15, further comprising a footrest sensor mat located upon the bottom surface of a footrest component of the lift chair.

17. The powered adjustment system for a lift chair of claim 16, wherein the electronic floor sensor mat controller employs software that identifies if an object is present on the floor sensing mat and/or is in contact with the footrest sensor mat via actively monitoring the status of a material within the floor sensor mat and/or footrest sensor mat.

18. The powered adjustment system for a lift chair of claim 17, wherein the software identifies a change in the status of the material as the presence of an object on the floor sensor mat and/or in contact with footrest sensor mat.

19. The powered adjustment system for a lift chair of claim 18, wherein a change in the status of the material is an electrical change.

20. The powered adjustment system for a lift chair of claim 18, wherein a change in the status of the material is a change in strain, pressure, deflection, or a combination thereof.

* * * * *